US005487451A

United States Patent [19]

Hughes et al.

[11] Patent Number: 5,487,451

[45] Date of Patent: Jan. 30, 1996

[54] SYSTEM AND METHOD FOR DETERMINING THE AVAILABILITY OF AN ELEVATOR CAR FOR RESPONSE TO HALL CALLS

[75] Inventors: David M. Hughes, New Britain; Gary Meguerdichian, Farmington, both of Conn.

[73] Assignee: Otis Elevator Company, Farmington, Conn.

[21] Appl. No.: 187,669

[22] Filed: Jan. 26, 1994

[51] Int. Cl.[6] ..... B66B 3/00

[52] U.S. Cl. ..... 187/392; 187/414; 250/495.1

[58] Field of Search ..... 187/391, 392, 187/317, 901, 414; 250/342, 495.1

[56] References Cited

U.S. PATENT DOCUMENTS

| | | | |
|---|---|---|---|
| 3,168,164 | 2/1965 | Kiely | 187/392 |
| 3,967,702 | 7/1976 | Iwaska et al. . | |
| 4,026,389 | 5/1977 | Magee . | |
| 4,112,419 | 9/1978 | Kinoshita et al. | 367/94 |
| 4,555,724 | 11/1985 | Enriquez | 348/61 |
| 4,849,635 | 7/1989 | Sugimoto | 250/342 |
| 4,874,063 | 10/1989 | Taylor . | |
| 4,951,786 | 8/1990 | Haraguchi . | |
| 5,001,557 | 3/1991 | Begle | 384/166 |
| 5,068,537 | 11/1991 | Ishikawa et al. | 250/342 |
| 5,192,836 | 3/1993 | Schroder . | |
| 5,202,540 | 4/1993 | Auer et al. | 187/247 |
| 5,219,042 | 6/1993 | Sattar et al. . | |
| 5,278,657 | 1/1994 | Tamura | 348/311 |
| 5,315,434 | 5/1994 | Mizuno et al. | 359/355 |

*Primary Examiner*—Peter S. Wong
*Assistant Examiner*—Robert E. Nappi

[57] ABSTRACT

A system and method for determining the availability of an elevator car for response to hall calls includes a plurality of infrared sensors disposed to monitor the presence of an object within an elevator car. The cross-sectional area occupied by an object, or objects, within an elevator car is determined by the number of sensors generating output signals based upon reflections of transmitted radiation from such an object. The system monitors the cross-sectional area availability of the elevator car and categorizes the car as to its availability for responding to a hall call.

9 Claims, 4 Drawing Sheets

SYSTEM AND METHOD FOR DETERMINING THE AVAILABILITY OF AN ELEVATOR CAR FOR RESPONSE TO HALL CALLS

TECHNICAL FIELD

The present invention generally relates to a system and method for determining the availability of an elevator car for response to hail calls and, in particular, relates to one such system including means for determining the cross-sectional area of the elevator car available to receive oncoming passengers.

BACKGROUND OF THE INVENTION

When there are a plurality of elevator cars servicing a facility, the individual elevator cars are assigned or dispatched to respond to a hail call on the basis of a combination of factors. Such factors can include the current direction of travel of each car, the proximity of each car to the origination of the hail call, the weight capacity available of each car, the comparative availability of other cars, as well as other factors. Typically, however, the most widely used factor is the weight of the current load in the elevator car. This information is frequently used to estimate the number of passengers on the elevator car.

Conventional dispatching systems are designed to minimize the mount of waiting time a user experiences between the time the user calls for the elevator car and the arrival thereof. Typically, such systems primarily rely on the weight of the load in the elevator car and, in some instances, the weight distribution within the car. However, in many instances, for example, in businesses, health care facilities, loading areas and freight areas, a user can frequently be frustrated when an elevator car arrives with equipment, a patient, or the like, therein and there is little or inadequate space within the elevator car for oncoming passengers, or other equipment, waiting to enter the elevator car. This condition can result from the inability of current elevator control and dispatching systems to distinguish the actual cross-sectional area occupied by objects and people in an elevator car based upon the weight or weight distribution thereof. One reason for this is that quite frequently the equipment being transported, such as, for example in the case of a health care facility, might be an empty gurney, can be so deceptively light that an elevator car carrying such equipment may appear to have an appropriate remaining weight capacity that the car will be assigned to respond to a hail call when, in fact, because of the cross-sectional area occupied by the gurney, there is little or no room remaining in the elevator car to comfortably receive passengers or equipment.

One known approach to addressing the control of elevators is the system described in U.S. Pat. No. 3,967,702 that teaches a system for monitoring the number of passengers in an elevator car. In that particular system, the number of passengers waiting for an elevator car at each stop having a registered hall call is determined. This information is then used to determine the availability of each elevator car to respond to each particular hall call.

Another system addressing the control and dispatching of an elevator car is taught in U.S. Pat. No. 5,219,042 wherein a plurality of weight sensors are used to determine the number of passengers currently on the elevator car. This system is used to evaluate the overall traffic pattern of the elevators.

In U.S. Pat. No. 5,192,836 a system is taught wherein the space available for passengers is determined based upon the estimated load weight in the elevator car. This system also uses the call condition, i.e., whether of not there is already a hall call for the car from a handicapped person, to determine whether or not a particular car can be dispatched to respond to that call.

A system for detecting the load distribution within an elevator car is taught in U.S. Pat. No. 4,951,786 issued to Haraguchi on Aug. 28, 1990 and assigned to the assignee hereon. Therein, a matrix of weight sensors is disposed in the floor of the elevator car whereby it can be determined if a particular load is a person or a piece of equipment. This information is then used to regulate the response of the car to hall calls.

However, none of these systems provides a full solution to the difficulty faced by passengers confronted with various pieces of equipment when attempting to utilize an elevator. Consequently, it is highly desirable to provide a system and method for determining the availability of an elevator car to respond to hall calls that includes a means for determining the available cross-sectional area of an elevator car which information can then be used as a factor in dispatching an elevator car to respond to a hall call.

DISCLOSURE OF THE INVENTION

Accordingly, it is one object of the present invention to provide a system and method for determining the availability of an elevator car to respond to hall calls based on the amount of cross-sectional area within the elevator ear available for oncoming passengers.

This object is accomplished, at least in part, by a system for determining the availability of an elevator car to respond to hall calls including means for determining the cross-sectional area of the elevator car available for oncoming passengers.

Other objects and advantages will become apparent to those skilled in the art from the following best mode for carrying out the invention read in conjunction with the appended claims and the drawings attached hereto.

BEST MODE FOR CARRYING OUT THE INVENTION

Figure 1:
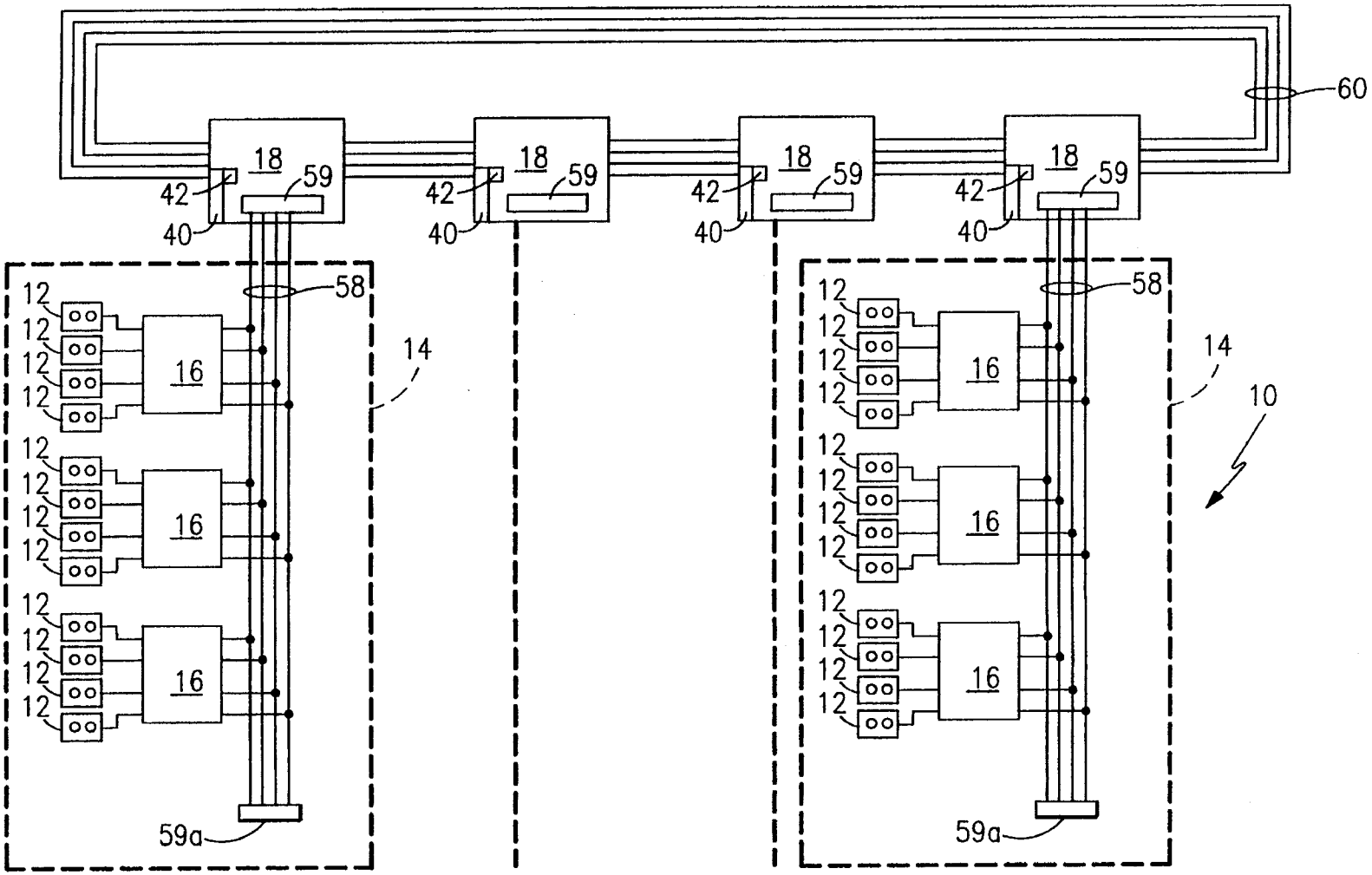
FIG. 1 is a schematic diagram of a system, embodying the principles of the present invention, for determining the availability of an elevator car to respond to a hall call.

A system 10 for determining the availability of an elevator car to respond to a hall call and embodying the principles of the present invention, includes a plurality of sensors 12 disposed within each elevator car 14, means 16, associated with each elevator car 14, for receiving and processing signals from the sensors 12 and means 18, communicating with the sensor signal receiving and processing means 16, for operationally controlling the dispatching of the elevator car 14 in response to a hall call.

Figure 2:
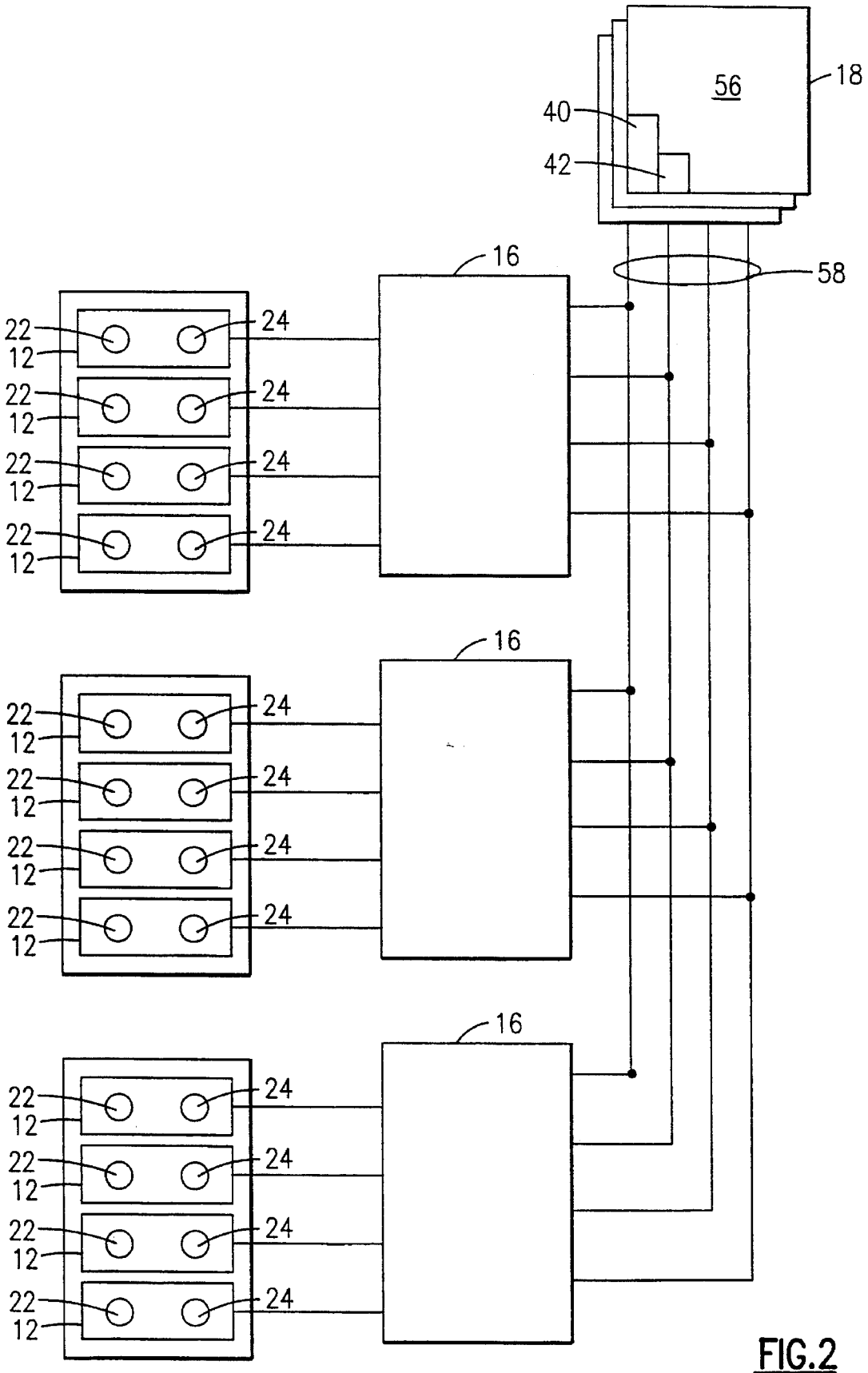
FIG. 2 is a block diagram of a single elevator of the system shown in FIG. 1.
Figure 3:
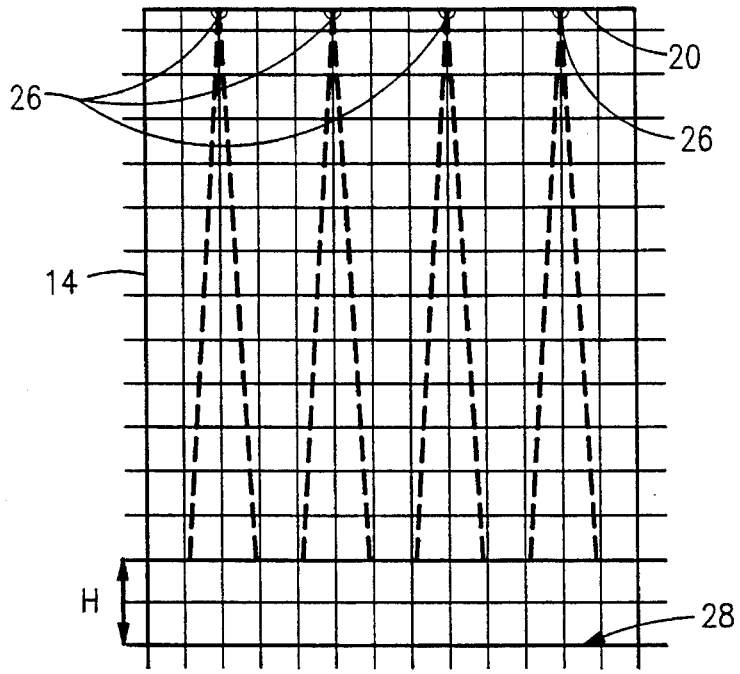
FIG. 3 is a cross-sectional view of an elevator car embodying the principles of the present invention.

Although a system 10 having four elevator cars 14 is shown in FIG. 1, the system 10 can have only a single elevator car 14 or any other number of elevator cars 14. Hence, the present invention is not dependent or limited by the number of elevator cars 14 in the system 10. Further, for clarity, the details of present invention are described hereinafter with respect to a single elevator car 14. Thus, FIG. 2 depicts one of the elevator cars 14 in the system 10 and each car 14 of the system 10 preferably includes the features discussed hereinafter.

In one embodiment, as particularly well shown in FIGS. 2–5 each elevator car 14 includes a plurality of the sensors 12 which are disposed within or proximate the ceiling 20 of the elevator car 14. Although any configuration can be implemented it is preferred, as shown in the Figures, that the sensors 12 be arranged in an orthogonal array of rows and columns.

In the preferred embodiment, each sensor 12 includes an infrared transmitter 22 and an infrared receiver 24, or detector. In addition, although not a necessary or limiting requirement, each sensor 12 can be provided with an optical window 26, or lens, that allows both the transmitted and the received infrared energy to be focussed. Such sensors 12 are known in the art and are commercially available. For example, typical infrared sensors that would be particularly useful for inclusion in the present invention would be those in the MP Series of Modular Photoelectric Controls manufactured and distributed by Micro Switch Co. of Freeport, Ill. In such sensors 12 each infrared transmitter 22 is designed to transmit an infrared signal and each infrared receiver 24 is designed to receive reflected infrared energy. The sensors 12 can be either dark operated or light operated. That is, the sensor 12 can be set to generate an output signal either when the reflected signal is blocked (dark operated) or when the reflected light is unblocked (light operated). For the purposes of the present discussion, the sensors 12 will be described as operating in the light operated mode such that the infrared receiver 24 produces, or outputs, an electrical signal in the presence of reflected incident infrared energy. It will be understood that the present invention is not limited to operation in the light operated mode and that the sensors 12 could be used in the dark operated mode as well.

In one mode of operation of the system 10, the threshold, or sensitivity, of each of the infrared receivers 24 is adjusted so that only infrared reflections originating from above a preselected height H from the floor 28 of the elevator car 14 will result in an output signal being produced by the infrared receiver 24. The threshold, or sensitivity, of the infrared receivers 24 is generally taken to mean the minimum amount of infrared energy that must be received in order to initiate, or cause the production of, an electrical output signal. Consequently, by such an adjustment, when there are no objects within the elevator car 14 only negligible infrared energy reaches the receiver 24 and no output signal is produced. The ability to adjust the threshold for the sensors 12 is a feature that is inherent in the commercially available sensors 12. Consequently, further detailed discussion of this feature is not believed necessary for a full understanding of the present invention.

The number and spacing of the sensors 12 used in the system 10 will be dependent upon the minimum size object that would be of interest in determining the available cross-sectional area in the elevator car 14. This information is then utilized to determine whether or not a particular elevator car 14 is available to respond to a hall call. That is, the number of sensors 12 provided should be at least that number necessary to determine whether or not there is an object, or objects, of sufficient size within the elevator car 14 that would make it inappropriate to send the elevator car 14 in response to a hall call.

Figure 4:
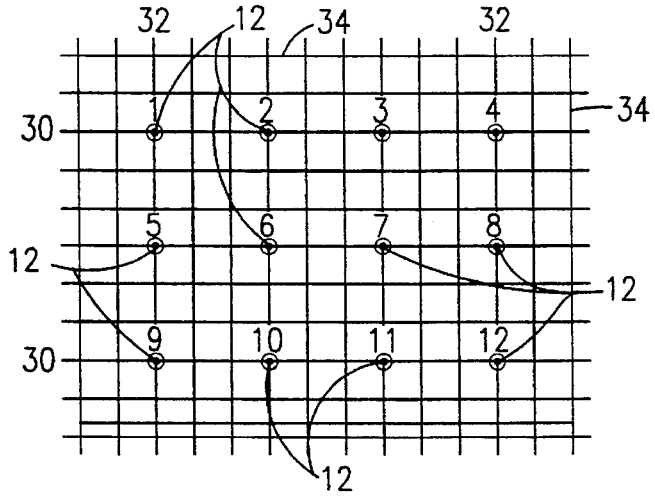
FIG. 4 is a top view of the elevator car shown in FIG. 3 and embodying the principles of the present invention.
Figure 5:
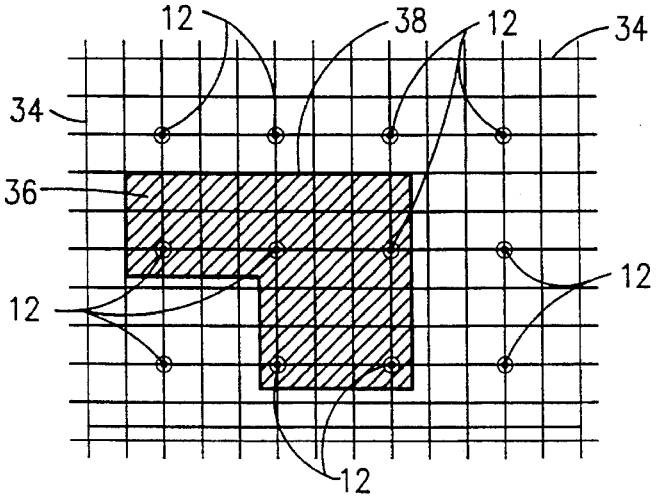
FIG. 5 is a top view of the elevator car shown in FIGS. 3 and 4 depicting an object therein being sensed in accordance with the principles of the present invention.

In one particular embodiment, wherein an elevator ceiling 20 having a width of about 5 feet and a depth of about 4 feet is available in the elevator car 14, twelve (12) sensors 12 are installed. In such an embodiment, as shown in FIG. 4, the outside rows 30 and the outside columns 32 are spaced apart from the walls 34 of the elevator car 14 about 12 inches. In addition, in such an embodiment, the sensors 12 are spaced apart from each other on about 12 inch centers. Thus, each sensor 12 outputs a signal indicative of the presence of an object 36 within a particular section of the elevator car 14.

In a typical embodiment, the beam diameter of the infrared energy transmitted from each of the transmitters 22 at the height H above the floor 28 of the car 14 will be about 0.5 inches in diameter. Such a narrow beam is selected to avoid cross-talk between adjacent sensors 12 as well as to provide a reasonable resolution of objects 36 within the car 14.

In operation, the threshold of each sensor 12, as previously discussed, is adjusted such that no signal is outputted by the infrared sensor 12 unless there is an object 36 within the elevator car 14 having a height greater than the predetermined height H. In the event that such an object 36 is within the elevator car 14, for example, such as shown in FIG. 4, the sensors 12 receiving a reflected signal above the threshold will output an electrical signal to the means 16 for receiving and processing signals. For example, only those sensors 12 disposed above the cross-hatched area 38 in FIG. 5 will receive a reflected signal from the object 36 of a strength greater than the threshold. The number and configuration of the sensors 12 outputting a signal is thus indicative of the cross-sectional area within the elevator car 14 that is occupied. In the preferred embodiment, the infrared transmitters 22 and the infrared receivers 24 of the sensors 12 are operated continuously.

In the preferred embodiment, the means 16 for receiving and processing signals from the sensors 11 is a conventional interface and signal level translator board. The interface and signal level translator board receives signals from the sensors 12 and adjusts the signal levels so that the signal communicated to the means 18 is recognizable and usable thereby. Although a plurality of sensors 12 are shown interconnecting to one of the boards 16 it should be understood that the number of boards 16 associated with each elevator car 14 is a matter of design choice. Hence, the present invention can be readily adapted for integration into current systems as well as included into new systems where only a single board may be used.

Preferably, the means 18 for controlling the operation and dispatching of the elevator cars 14, via the means 16 for receiving and processing signals, includes a computing device 40 and a memory 42. The configuration of the sensors 12 can be stored in the memory 42 accessible to and by the computing device 40. In addition, as more fully discussed below, the means 18 is programmed to output an available/unavailable signal to the operation and dispatching means 18 of the other elevator cars 14 in accordance with the method of the present invention.

Figure 6:
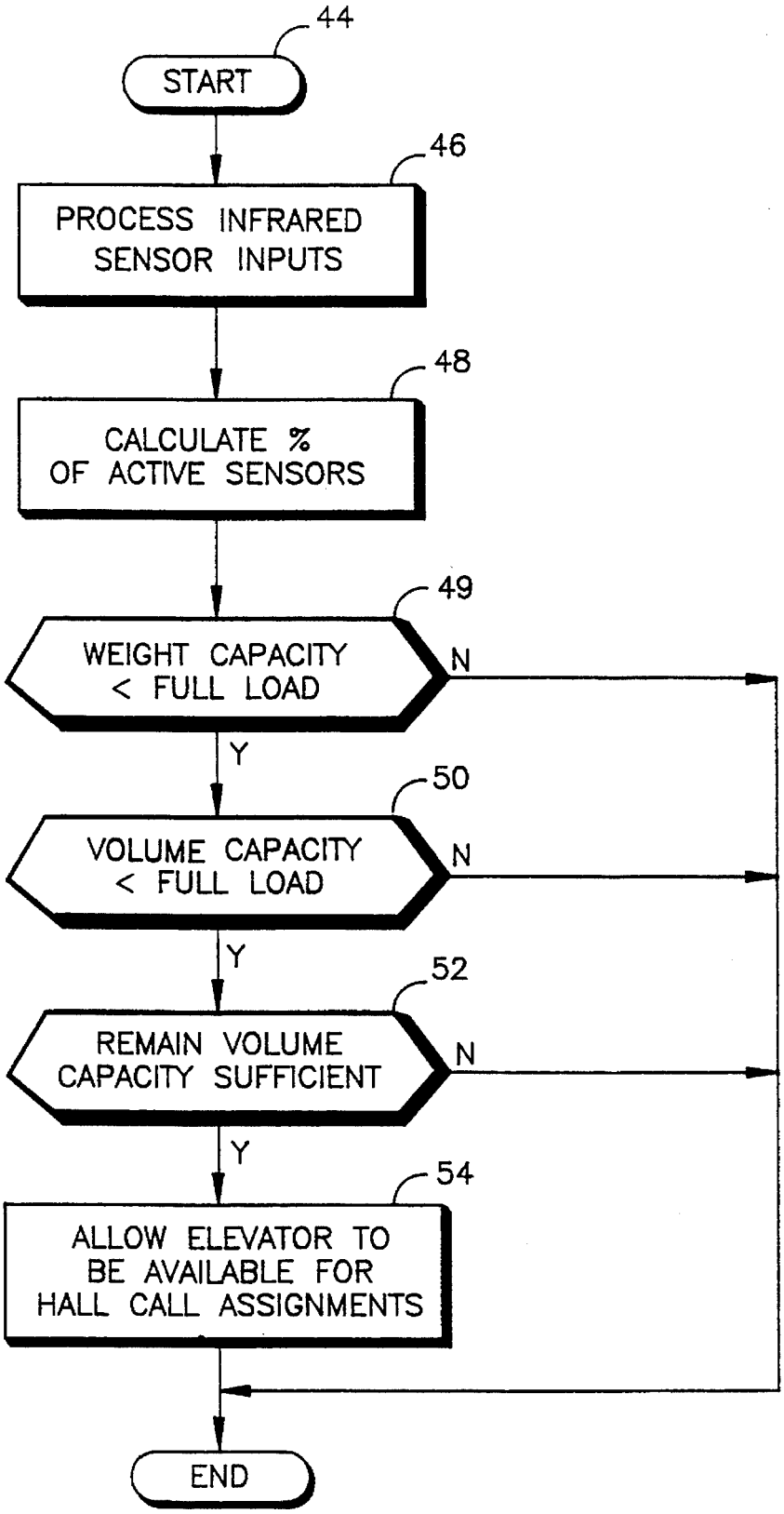
FIG. 6 is a flow chart illustrating the method of operation of the present invention for determining the availability of an elevator car for responding to a hall call.

In one embodiment, the means 18 determines the availability/unavailability of the elevator car 14 in accordance with the method steps shown in FIG. 6. The method can be initialized 44 by, for example, a conventional clock signal. As depicted at 46 the computing device 40 then processes the outputted signals from the sensors 12. In one embodiment, the computing device 40 simply counts the number of sensors 11 outputting signals. From such a count the computing device 40 then determines, at 48, the percentage of active sensors 12 and thus ascertains the currently available load capacity of the elevator car 14 in terms of cross-sectional area.

As shown at element 49, the weight load capacity is determined. An initial conventional load weight capacity check is made to ensure that the weight load of the elevator car 14 is within acceptable limits to receive oncoming passengers. Thereafter, as shown at element 50, if the cross-sectional area occupied is less than the full capacity of the elevator car 14 the computing device 40 compares the remaining cross-sectional area to a preselected value at step 52. If the computing device 40 determines that the cross-sectional area occupied is equal to the full capacity of the elevator car 14 the program ends and a signal indicating unavailability is generated.

The preselected value can be chosen by using conventional elevator availability parameters and typical traffic patterns. For example, it may be predetermined that if more than 50% of the cross-sectional area of an elevator car 14 is occupied, the elevator car 14 should not be made available to respond to hall calls. Of course, the preselected value may be automatically varied among the elevator cars 14 of a facility if all such cars 14 indicate that they are unavailable.

If the cross-sectional area occupied, as indicated by the number of sensors 12 outputting a signal, is less than the preselected value, the computing device 40 outputs at 54 an availability signal to the system operation and dispatching means 18. If the load capacity is exceeded or if the preselected value is exceeded, the computer outputs a signal indicating the unavailability of the elevator car 14.

The operation and dispatching means 18 for the elevator cars 14 in response to a hall call preferably includes a plurality of circuit cards 56, each circuit card being associated with one of the elevator cars 14. In the preferred embodiment, the circuit cards 56 are data communication cards. In operation, the means 16 for receiving and processing signals from the sensors 12 communicates with the circuit cars 56 by means of a data bus 58. Such may be a serial link such as disclosed in U.S. Pat. No. 4,622,551 wherein the bus 58 is used as a half-duplex serial link and each interface 16 is an industrial communication unit used as a slave connected to a master 59 which polls the slaves for information in the first half of a series of transceive cycles. In that case, the serial link 58 is terminated with an impedance 59*a* at each end, i.e., including a similar but not shown impedance within the master 59. The circuit cards 56 may, but need not, be connected in a closed data loop 60 and each circuit card 56 communicates with each other to determine the availability of the elevator car 14 associated therewith. Such a closed data loop 60 will be in the form of a ting communication dispatching loop found in a type of elevator system, but the invention is not restricted thereto. Advantageously, this approach allows the present invention to not only be implemented in new systems but also allows current systems to be retrofitted. Thus, by the use of the system 10, the availability of each elevator car 14 is signalled according to the cross-sectional area available therewithin. Hence, users of the elevator cars 14 will not be faced with the frustration of an arriving elevator car that does not have sufficient room therein because of the presence of equipment.

Although the present invention has been described herein with respect to one or more particular embodiments, it would be understood by those skilled in the art that other arrangements and configurations may be made which do not depart from the spirit and scope of the present invention. Hence, the present invention is being limited only by the appended claims and the reasonable interpretation thereof.

What is claimed is:

1. A system for determining the availability of an elevator car, said system comprising:

an orthogonal array of at least twelve sensors, said orthogonal array being disposed within the elevator car, each sensor of said orthogonal array having a transmitter and a receiver and each sensor outputting a signal indicative of the presence of an object within a section of said elevator car; and means for receiving and processing said signals from said sensors to determine a cross-sectional area of said elevator car available for oncoming passengers.

2. The system as claimed in claim 1 wherein said sensors are spaced apart on 12 inch centers.

3. The system as claimed in claim 1 wherein said sensors are disposed proximate a ceiling of said elevator car.

4. The system as claimed in claim 1 wherein said sensors are operated in a light operated mode.

5. The system as claimed in claim 1 wherein said sensors are operated in a dark operated mode.

6. The system as claimed in claim 1 wherein a sensitivity of each sensor of said plurality of sensors is set such that said output signal is generated only when an object is at least a preselected height above a floor of said elevator car.

7. The system as claimed in claim 1 further comprising a plurality of lenses, each lens of said plurality of lenses being associated with a corresponding sensor of said plurality of sensors.

8. The system as claimed in claim 1 wherein said means for receiving and processing signals from said sensors includes:

a interface and signal level translator board.

9. The system as claimed in claim 1 further includes means for controlling the operation and dispatching of elevator cars; said operation and dispatching means including:

a computing device, said computing device having a memory associated therewith; and means for determining said cross-sectional area available within said elevator car for receiving oncoming passengers in response to signals received from said sensors.

* * * * *